US007278701B2

(12) United States Patent
Fagan et al.

(10) Patent No.: US 7,278,701 B2
(45) **Date of Patent: *Oct. 9, 2007**

(54) METHOD OF INFORMING A USER OF AN IMAGING APPARATUS OF AN EVENT VIA A PRINT FADE

(75) Inventors: Mark W Fagan, Lexington, KY (US); Brian T. Jones, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 427 days.

This patent is subject to a terminal disclaimer.

(21) Appl. No.: 10/630,418

(22) Filed: Jul. 30, 2003

(65) Prior Publication Data

US 2005/0024405 A1 Feb. 3, 2005

(51) Int. Cl.
*B41J 29/38* (2006.01)
*B41J 2/205* (2006.01)

(52) U.S. Cl. ..... 347/14; 347/15

(58) Field of Classification Search ..... 347/7, 347/9, 14, 15, 19, 40–43, 84
See application file for complete search history.

(56) References Cited

U.S. PATENT DOCUMENTS 5,663,750 A * 9/1997 Sakuma ..... 347/7
6,130,685 A 10/2000 Matsubara et al.
6,145,950 A 11/2000 Ohtsuka et al.
6,260,938 B1 7/2001 Ohtsuka et al.
6,286,925 B1 9/2001 Heinzl et al.
6,505,910 B1 1/2003 Doval et al.
6,962,399 B2 * 11/2005 Anderson et al. ..... 347/14
2002/0012018 A1 1/2002 Ohtsuka et al.
2002/0021315 A1 2/2002 Sato et al.
2002/0167575 A1 11/2002 Kitabatake et al.

* cited by examiner

*Primary Examiner*—An H. Do
(74) *Attorney, Agent, or Firm*—Taylor & Aust, PC

(57) ABSTRACT

A method of informing a user of an imaging apparatus of an event, the imaging apparatus having a plurality of print modes, includes the steps of defining a notice threshold that is associated with the event; determining whether the notice threshold has been reached; and upon reaching the notice threshold, progressively reducing an image density of an image formed by the imaging apparatus based on a print mode the imaging apparatus was operating in when the notice threshold was reached. Alternatively, imaging density may be progressively reduced based on reaching a next fade area of a plurality of fade areas for the print medium.

20 Claims, 6 Drawing Sheets

METHOD OF INFORMING A USER OF AN IMAGING APPARATUS OF AN EVENT VIA A PRINT FADE

BACKGROUND OF THE INVENTION

1. Field of the Invention

The present invention relates to an imaging apparatus, and more particularly, to a method of informing a user of an imaging apparatus of an event via a print fade.

2. Description of the Related Art

An imaging apparatus utilizes a print engine to form an image on a print media, such as a sheet of paper or transparency. Such print engines come in two general forms: electrophotographic and ink jet. For example, an ink jet printer has associated therewith a consumable, such as for example, an ink supply tank or an ink jet cartridge, that contains a supply of ink that is consumed during an imaging process. During the imaging process, ink is selectively ejected from a plurality of nozzles in a printhead to form a printed image. Various events can occur during printing of which the user may be informed in some manner. For example, a notice may be provided to the user of the upcoming exhaustion of the ink supply.

One such method of providing such a notice to the user is to notify the user of the reduced ink that remains in the consumable, such as, for example, by reducing the density of a printed image. In one known implementation of this method, the duration of a preheat pulse applied to a heater in the printhead is changed so as to affect the amount of ink expelled from the associated nozzle. By shortening the preheat pulse, the size of the expelled ink drop is reduced, thereby decreasing the density of the printed image. Another approach is to change to a draft mode from another printing mode when a certain ink level is reached to thereby reduce the recording pixel numbers. Such approaches, however, may be misinterpreted as, for example, a printhead failure, or that the wrong print mode was inadvertently selected.

What is needed in the art is a method of informing a user of an imaging apparatus of an event by fading print in a manner that is readily discernable by a user as an indicator of the event.

SUMMARY OF THE INVENTION

The present invention provides a method of informing a user of an imaging apparatus of an event by fading print in a manner that is readily discernable by a user as an indicator of the event.

In one form thereof, the invention relates to a method of informing a user of an imaging apparatus of an event, the imaging apparatus having a plurality of print modes. The method includes the steps of defining a notice threshold that is associated with the event; determining whether the notice threshold has been reached; and upon reaching the notice threshold, progressively reducing an image density of an image formed by the imaging apparatus based on a print mode the imaging apparatus was operating in when the notice threshold was reached.

In another form thereof, the invention relates to an imaging apparatus having a plurality of print modes selectable by a user. The imaging apparatus includes a print engine and a memory that stores a notice threshold associated with an event. A control system is coupled to the print engine and is coupled to the memory. The control system is configured to perform the steps of determining whether the notice threshold has been reached; and upon reaching the notice threshold, progressively reducing an image density of an image formed by the imaging apparatus based on a print mode the imaging apparatus was operating in when the notice threshold was reached.

In another form thereof, the invention relates to an ink jet printer having a plurality of print modes selectable by a user. The ink jet printer includes a carrier for carrying a printhead. The printhead is connected in fluid communication with a reservoir. The reservoir contains a supply of ink. A memory is provided that stores a notice threshold associated with a usable amount of ink in the reservoir having been depleted. A control system is coupled to the printhead and is coupled to the memory. The control system is configured to perform the steps of determining whether the notice threshold has been reached; and upon reaching the notice threshold, progressively reducing an image density of an image formed by the ink jet printer based on a print mode the ink jet printer was operating in when the notice threshold was reached.

In another form thereof, the invention relates to a method of informing a user of an imaging apparatus of an event. The method includes the steps of defining a notice threshold that is associated with the event; determining whether the notice threshold has been reached; and upon reaching the notice threshold, progressively reduce an image density of an image formed by the imaging apparatus based on reaching a next fade area of a plurality of fade areas for a print medium.

An advantage of the present invention is that the print fading due to the progressive reduction of the image density can be maintained relatively uniform as between the various printing modes, so that the user does not confuse, for example, the exhaustion of an ink supply with a failure of the printer and/or printhead.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
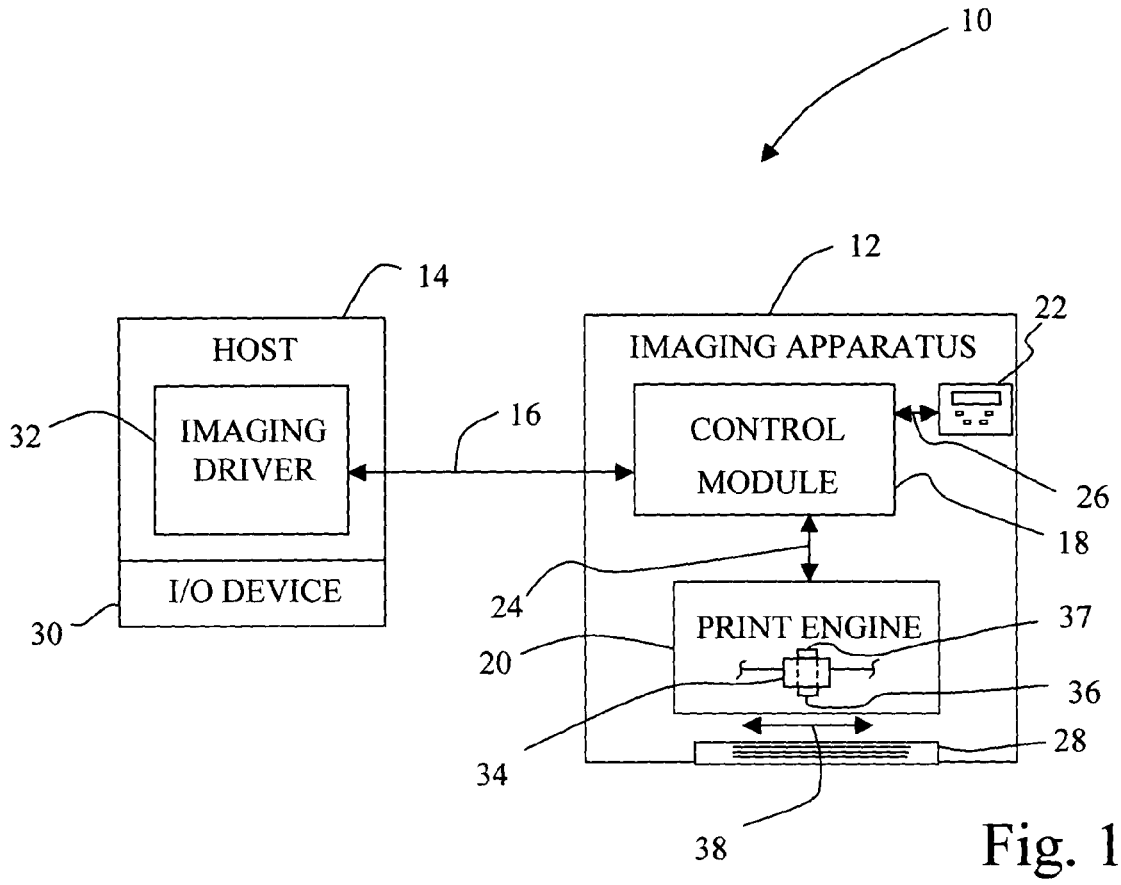
FIG. 1 is a diagrammatic illustration of a printing system embodying the invention.

Referring now to the drawings, and particularly to FIG. 1, there is shown a diagrammatic illustration of a system 10 embodying the present invention. System 10 includes an imaging apparatus 12 and a host 14. Imaging apparatus 12 communicates with host 14 via a communications link 16.

Imaging apparatus 12 can be, for example, an ink jet printer and/or copier, or an electrophotographic printer and/or copier. Imaging apparatus 12 includes a control module 18, a print engine 20 and a user interface 22.

Control module 18 includes a processor unit and associated memory, and may be formed as an Application Specific Integrated Circuit (ASIC). Control module 18 communicates with print engine 20 via a communications link 24. Control module 18 communicates with user interface 22 via a communications link 26.

In the context of the examples for imaging apparatus 12 given above, print engine 20 can be, for example, an ink jet print engine configured for forming an image on a print medium 28, such as a sheet of paper, transparency or fabric.

Host 14 may be, for example, a personal computer including an input/output (I/O) device 30, such as a keyboard and a display monitor. Host 14 further includes a processor, input/output (I/O) interfaces, memory, such as RAM, ROM, NVRAM, and a mass data storage device, such as a hard drive, CD-ROM and/or DVD units. During operation, host 14 includes in its memory a software program including program instructions that function as an imaging driver 32, e.g., printer driver software, for imaging apparatus 12. Imaging driver 32 is in communication with control module 18 of imaging apparatus 12 via communications link 16. Imaging driver 32 facilitates communication between imaging apparatus 12 and host 14, and may provide commands, information, and formatted print data to imaging apparatus 12, and more particularly, to print engine 20. Alternatively, however, all or a portion of imaging driver 32 may be located in control module 18 of imaging apparatus 12.

Further, a user of imaging apparatus 12 may enter commands via host 14 to select a particular print mode from a plurality of print modes, e.g., draft, normal, better, best, photo, etc., for use in imaging with imaging apparatus 12. Alternatively, a user may select a particular print mode at user interface 22.

Communications link 16 may be established by a direct cable connection, wireless connection or by a network connection such as for example an Ethernet local area network (LAN). Communications links 24 and 26 may be established, for example, by using standard electrical cabling or bus structures, or by wireless connection.

In an ink jet printer context, print engine 20 may include, for example, a reciprocating printhead carrier 34 that carries at least one ink jet printhead 36, and may be mechanically and electrically configured to mount, carry and facilitate multiple cartridges, such as a monochrome printhead cartridge and/or one or more color printhead cartridges, each of which including a respective printhead 36. For convenience, element number 36 will be used in referring to individual printheads or to multiple printheads. In systems that, for example, use cyan, magenta, yellow and black inks, printhead carrier 34 may carry four printheads 36, one printhead for each of the cyan, magenta, yellow and black inks.

Also, associated with print engine 20 is a consumable 37 that includes a supply of imaging substance. Such a consumable 37 may be, for example, a reservoir, e.g., a tank, and such an imaging substance may be, for example, ink. Further, in the case of an ink jet printer, consumable 37 may be, for example an on-carry ink reservoir, or an off carrier in reservoir. Further, consumable 37 may be combined with printhead 36 to form a unitary ink jet printhead cartridge.

Figure 2:
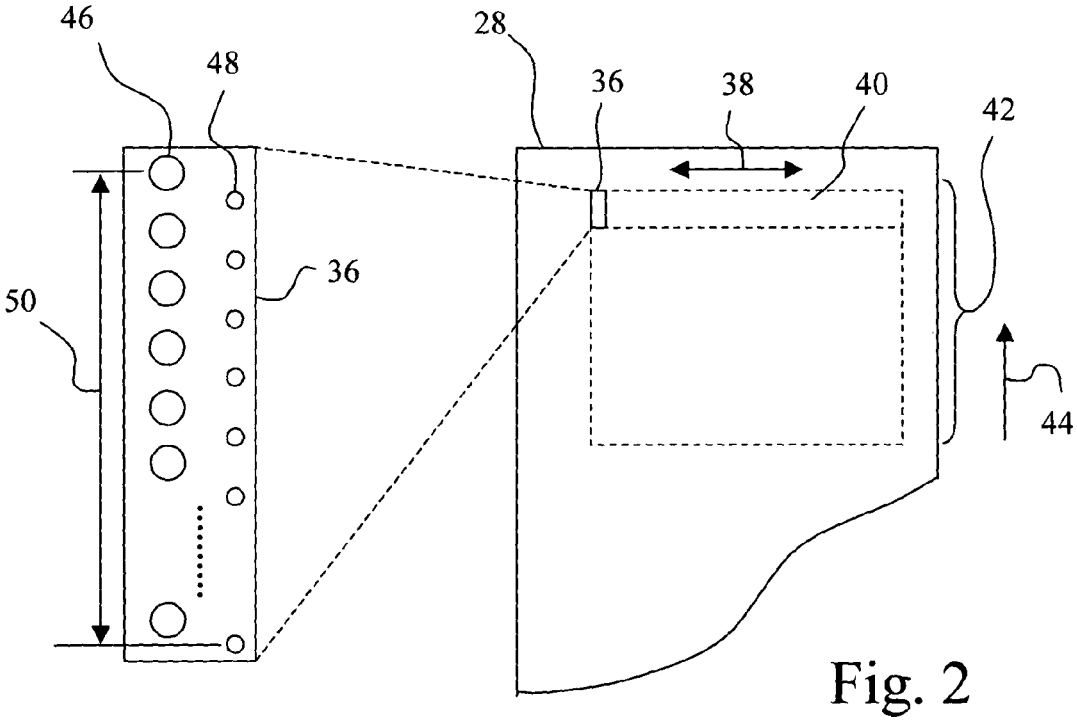
FIG. 2 is a view of a printhead of FIG. 1, projected over a print medium.

Referring also to FIG. 2, printhead carrier 34 is controlled by control module 18 to move printhead 36 in a reciprocating manner along a bi-directional scan path 38, which may also be referred to herein as horizontal direction 38. Each left to right, or right to left movement of printhead carrier 34 along bi-directional scan path 38 over print medium 28 will be referred to herein as a pass. The area traced by printhead 36 over print medium 28 for a given pass will be referred to herein as a swath, such as for example, swath 40 as shown. Accordingly, to print a given exemplary area 42 of print medium 28, the printhead 36 with make multiple passes and print multiple swaths, with print medium 28 being incrementally fed in a print medium feed direction 44. Where shingling is employed, several swaths that overlap in the print medium feed direction 44 may be required to completely print a particular print line, i.e., raster.

FIG. 2 also shows in enlarged and exaggerated form for ease of understanding a bottom view of an exemplary nozzle configuration for ink jet printhead 36. As shown, printhead 36 may be configured, for example, with both large nozzles 46 and small nozzles 48. Each ink drop expelled, or to be expelled, from each large nozzle 46 can be referred to as a large drop. Each ink drop expelled, or to be expelled, from each small nozzle 48 can be referred to as a small drop. A swath height of swath 40 corresponds to the distance 50 between the uppermost and lowermost of the nozzles of printhead 36.

Figure 3:
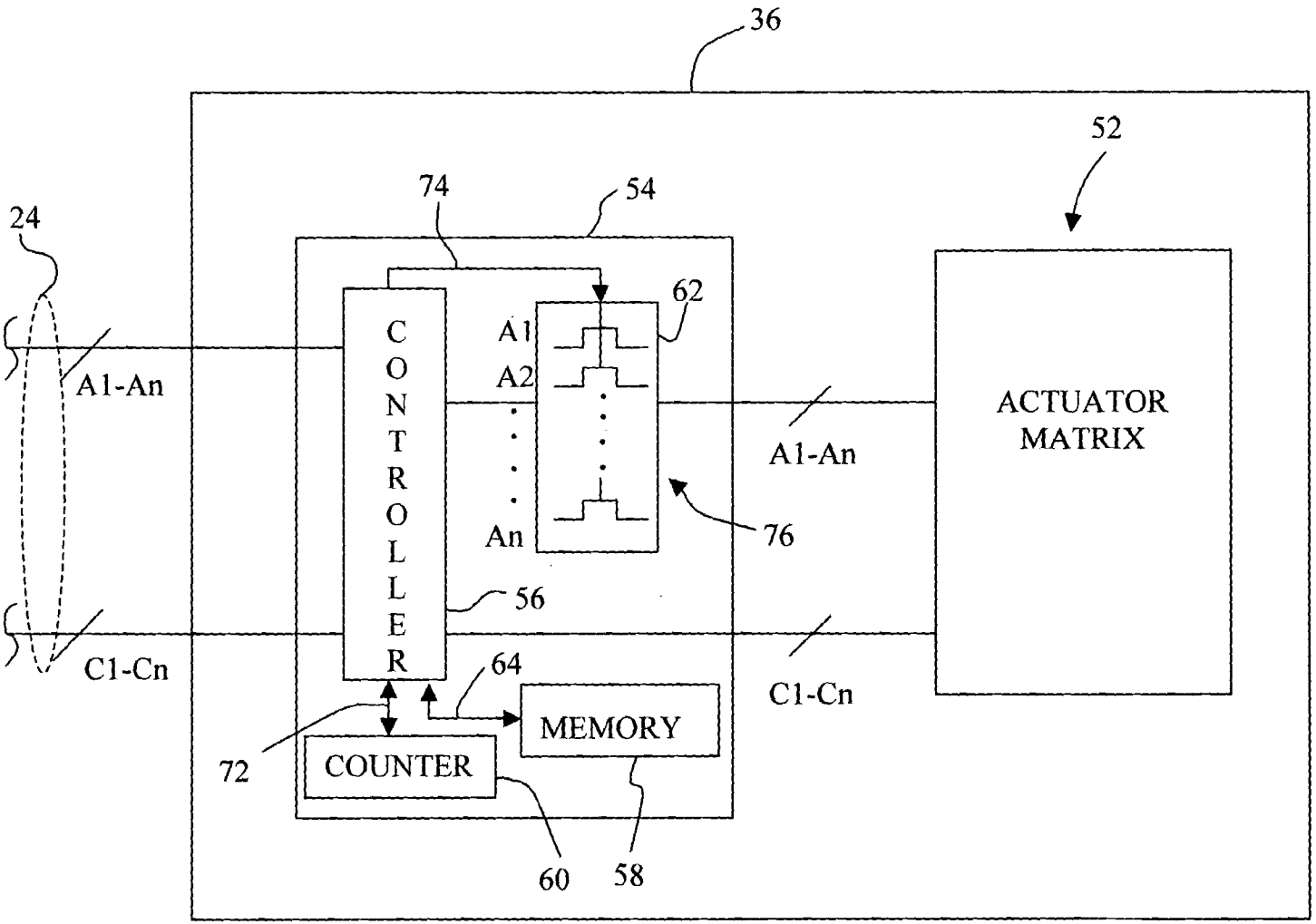
FIG. 3 is a block diagram illustrating electrical components included in the printhead of FIG. 1.

Referring to FIG. 3, printhead 36 includes a plurality of ink jetting actuators 52 and a logic unit 54. Communications link 24 may further include a plurality of primary address lines A1-An and a plurality of secondary address lines C1-Cn.

The plurality of ink jetting actuators 52 may be arranged, for example, in a matrix, with each actuator being positioned in association with a corresponding one of nozzles 46, 48 of printhead 36. The actuators 52 can be, for example, electrical heaters, or piezoelectric elements. Each actuator of the plurality ink jetting actuators 52 may be individually selected by a unique combination of one of the primary address lines A1-An and one of the secondary address lines C1-Cn.

Logic unit 54 is configured to carry out pre-programmed logic and arithmetic operations. Logic unit 54 includes a controller 56, a memory 58, a counter 60 and a switching unit 62. Control module 18 of imaging apparatus 12 is connected to controller 56 via communications link 24, which as shown includes primary address lines A1-An and secondary address lines C1-Cn.

Controller 56 processes address signals, and any auxiliary control signals, if applicable, received from control module 18 to determine whether one or more of the plurality of ink jetting actuators 52 are to be fired, i.e., energized. A count of the number of such firings by the plurality of ink jetting actuators 52 may be maintained by counter 60, or alternatively, by control module 18.

Figure 4:
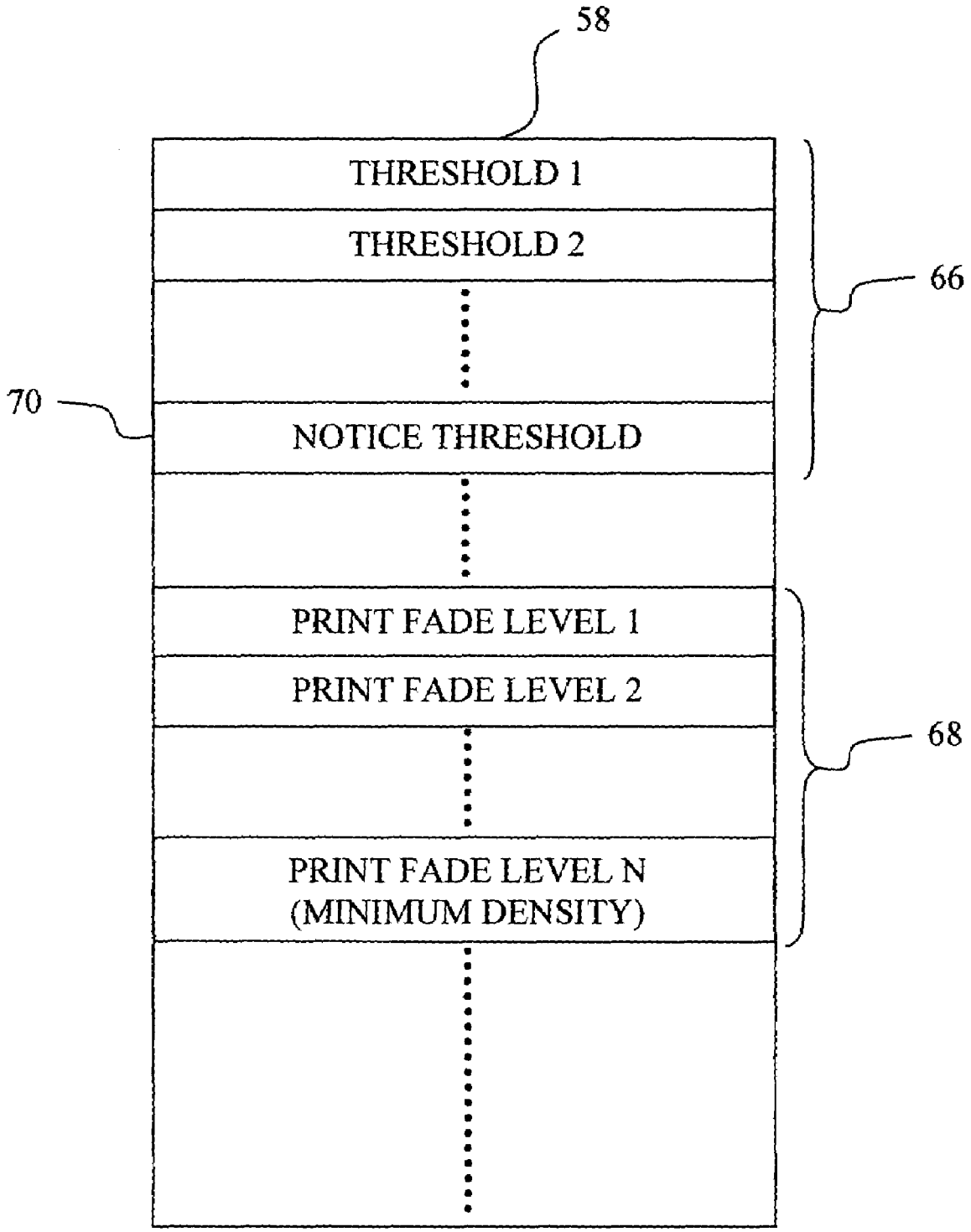
FIG. 4 is a graphical depiction of a portion of the memory of the printhead of FIG. 1.

Memory 58 is coupled in bi-directional communications with controller 56 via electrical path 64. Referring also to FIG. 4, memory 58 may include a usage threshold array 66 and a print fade array 68.

Usage threshold array 66 stores a plurality of count threshold levels, e.g., threshold 1, threshold 2, and a notice threshold 70. The count threshold levels, e.g., threshold 1, threshold 2, and notice threshold 70, define various thresholds pertaining to one or more events. One such event may be, for example, when the ink supply of reservoir 37 is about to be depleted, i.e., exhausted. According to this example, a count of the number of ink ejections, i.e., firings, by printhead 36, maintained by counter 60 will be compared by controller 56, or alternatively by control module 18, to the count threshold levels of usage threshold array 66, and when a particular threshold is reached, a predetermined operation is performed, such as setting a write once bit in a threshold level byte stored in memory 58 that a particular threshold level was reached. For example, the plurality of count thresholds may define progressively lower amounts of ink remaining in reservoir 37. Further, notice threshold 70 may serve as a defined level at which a user will begin receiving notification of the event, e.g., that the usable ink supply in reservoir 37 is depleted.

Print fade array 68 may be, for example, a plurality of write-once bits, or alternatively, a plurality of fuses. The print fade level bits 1-N of print fade array 68 are used in accordance with the present invention to indicate the print fade level, i.e., the gray level, that will be printed by printhead 36, after notice threshold 70 has indicated that an event, such as the depletion of usable ink in reservoir 37, has occurred. Each print fade level bit is predefined to correspond to a particular print density at which the image data will be printed by printhead 36.

Referring again to FIG. 3, counter 60 is coupled in bi-directional communications with controller 56 via electrical path 72. Counter 60 maintains a count of the number of firings of the plurality of ink jetting actuators 52, i.e., the number of energizing pulses applied to the plurality of ink jetting actuators 52.

Switching unit 62 is electrically coupled upstream of the plurality of ink jetting actuators 52. Switching unit 62 is communicatively coupled to controller 56 via an address select line 74. Switching unit 62 includes a plurality of individually selectable switching elements 76, such as FET transistors, for individually and selectively enabling or masking one or more of the address lines of printhead 36, such as for example, primary address lines A1-An. The individual selection of switching elements 76 is determined by controller 56, and is effected by the signals supplied to switching unit 62 via address select line 74. Such a configuration may be used, for example, to facilitate the progressive reduction of an image density of images formed by imaging apparatus 12 based on a selected print mode, as will be further detailed below.

In embodiments where imaging apparatus 12 is an ink jet printer, during operation, an amount of ink consumed by imaging apparatus 12 is estimated. This estimation may be based, for example, on the number of ink dots formed on print medium 28, e.g., a total number of actuator firings of the plurality of actuators 52, or on the number of ink dots formed on print medium 28 as compensated for by such factors as temperature, humidity and time. Alternatively, such an estimation of ink consumption can be based on a percent of image coverage on the print medium 28, the number of printed sheets exceeding a predetermined coverage amount, or simply the number of sheets of print media processed by imaging apparatus 12. Such an estimation may be performed, for example, by controller 56 of printhead 36. Alternatively, through inclusion of appropriate logic, this estimation can be performed, for example, at any one of control module 18, or the imaging driver 32, e.g., in the form of software, running on host 14. The estimated ink consumption is compared to the various threshold levels stored in usage threshold array 66. Controller 56 may report the attainment of a particular threshold level to control module 18. In particular interest with the respect to the present invention is the attainment of a monitored event, which in this example is when the estimated ink consumption has reached the value of notice threshold 70.

In accordance with the present invention, once notice threshold 70 is reached, individual print fade level bits 1-N in print fade array 68 of memory 58 may be set at a rate based on a print mode that imaging apparatus 12 was in when notice threshold 70 was reached. More particularly, in this embodiment, each print mode has associated therewith a predefined number of print swaths that will be counted before the next print fade bit is set. Control module 18 is programmed to count the number of print swaths that are printed after notice threshold 70 has been reached. The swath count is communicated to controller 56 in order to appropriately set a particular print fade level bit in print fade array 68 of memory 58, and in turn, to select the appropriate print density associated with the particular print fade level bit. In the embodiment shown in FIG. 3, for example, in order to reduce the print density of printhead 36, individual ones of the primary address lines A1-An and/or secondary address lines C1-Cn are masked so as to mask out a corresponding portion of the ink jetting actuators 52. With each addition print fade level bit set in print fade array 68 of memory 58, the number of address lines masked increases, and in turn the number of ink jetting actuators masked increases, so as to progressively reduce the print density of images formed by imaging apparatus 12 based on the print mode that imaging apparatus 12 was operating in when the event occurred, i.e., when notice threshold 70 was reached.

Thus, each time controller 56 sets a next print fade level bit in print fade array 68 of memory 58, controller 56 selects the associated image density corresponding to the next print fade level bit, and in turn, masks the appropriate primary address lines A1-An and/or secondary address lines C1-Cn to drop out certain ones of the nozzles 46, 48 of printhead 36. In one implementation of the present invention, for example, the masking is temporary and will not be carried over after the imaging substance supply in reservoir 37 has be renewed, or when imaging reservoir 37 is replaced.

Figure 5:
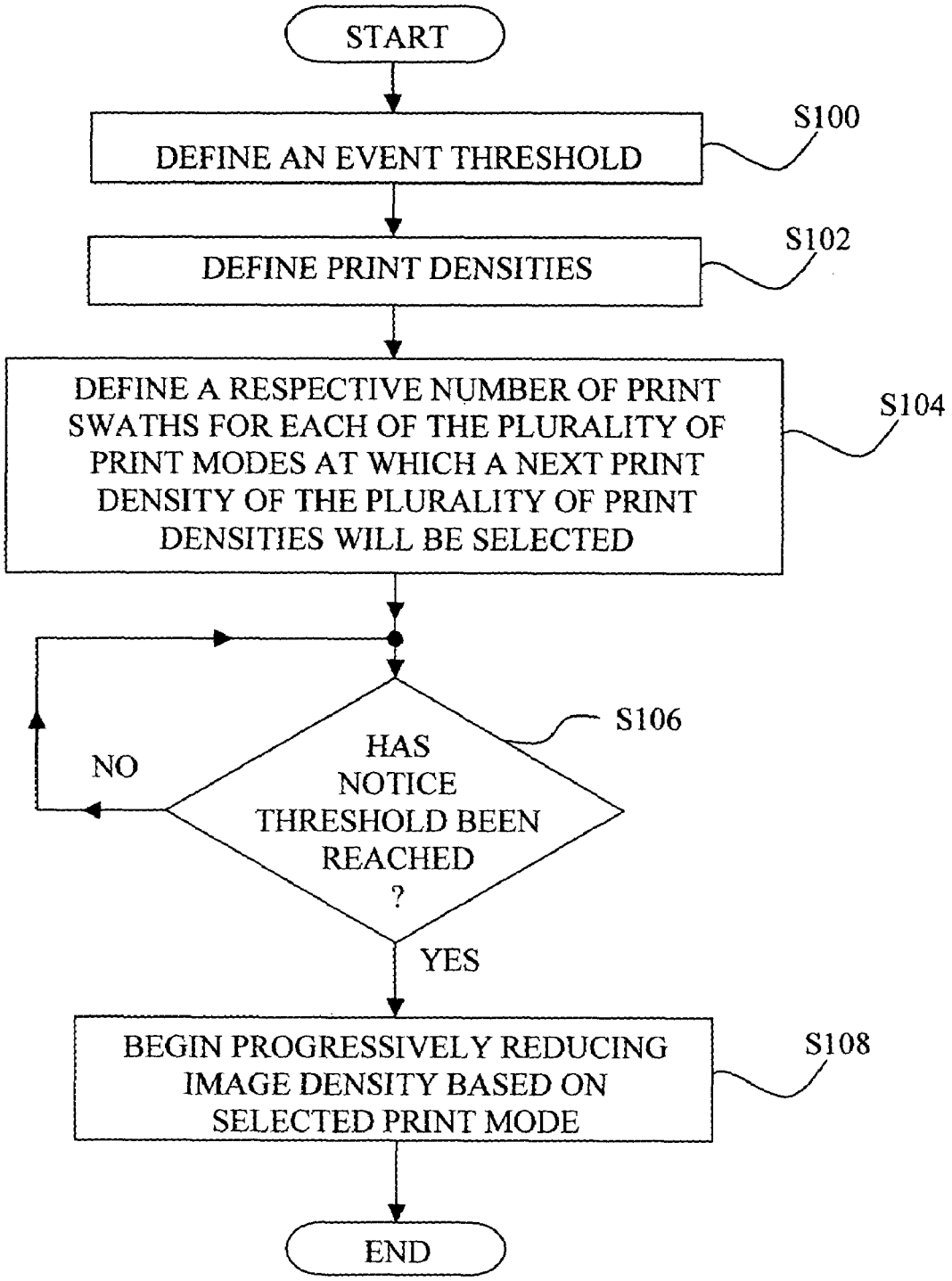
FIG. 5 is a general flowchart of one embodiment of a method for the present invention.

FIG. 5 is a flowchart of a method of informing a user of imaging apparatus 12 of an event.

At step S100, an event threshold is defined. In other words, the event to be monitored is identified and an indication of that event is defined as an event threshold. In keeping with the examples given above, the monitored event may be the event of a usable supply of ink in reservoir 37 becoming depleted, or about to be depleted, which is indicated when controller 56 reports to control module 18 that the estimated ink consumption has reached the value of notice threshold 70, i.e., the event threshold.

At step S102, a plurality of print densities are defined. Controller 56 associates a particular print density, i.e., fade amount, with each of the print fade level bits 1-N stored in print fade array 68. For example, if N=10, the ten levels of fade can be accommodated, corresponding to ten different print densities, e.g., 90%, 80%, 70%, 60% 50%, 40%, 30%, 20%, 10% and 3 percent. Each of the fade increments, e.g., from 90% to 80%, from 80% to 70%, etc., may be achieved, for example, via controller 56 and switching unit 62 selectively individually masking one or more of the plurality of primary address lines A1-An and/or secondary address lines C1-Cn. Alternatively, such fade increments may be achieved using other methods, such as by thinning the print data at either host 14 or control module 18, or by other methods known in the art.

At step S104, a respective number of print swaths is defined for each of the plurality of print modes at which a next print density of the plurality of print densities defined in step S102 will be selected.

It has been determined that in order to have a relatively uniform fade amount as between various print modes, it is desirable for imaging apparatus 12 to compensate for the number of print swaths associated with a print mode for completely printing a print line, i.e., raster. In the present embodiment, the rate at which the print densities, i.e., levels of fade, are incremented, i.e., selected, depends on the print mode, and that rate may be set in terms of a number of print swaths. The number of print swaths, X, may be determined empirically, such as through the observation of various rates for achieving the desired print fade for a particular print mode. The Table 1 shows exemplary values for the number of print swaths, X, that will be counted before performing the next incremental print fade, i.e., when selecting the next print density in forming the image on print medium 28.

TABLE 1

Exemplary values for the number of print swaths, X, based on print mode.

| MODE | NUMBER OF PRINT SWATHS, X |
|---|---|
| MONOCHROME DRAFT | 1 |
| MONOCHROME NORMAL | 2 |
| MONOCHROME BETTER | 5 |
| MONOCHROME BEST | 10 |
| COLOR DRAFT | 2 |
| COLOR NORMAL | 5 |
| COLOR BETTER | 15 |
| COLOR BEST | 35 |

In general, the printing resolution increases from draft mode to best mode, wherein, for example, draft mode may be 600×600 dpi (dots per inch), normal may be 1200×1200 dpi, better may be 2400×1200 dpi and best mode may be 4800×1200 dpi. If desired, the results for monochrome and color set forth in Table 1 can be combined, e.g., averaged, to obtain a compromise fade uniformity for both monochrome and color, as set forth in Table 2.

TABLE 2

Exemplary combined values for the number of print swaths, X, based on print mode.

| MODE | NUMBER OF PRINT SWATHS, X |
|---|---|
| DRAFT | 2 |
| NORMAL | 4 |
| BETTER | 8 |
| BEST | 16 |

Also, if desired, the values for the number of print swaths, X, may be varied based on a determined, either selected or measured, print media type, e.g., plain paper, glossy paper, photo paper, etc.; image content, or vertical position on print medium 28, as determined, for example, by control module 18.

At step S106, it is determined whether the notice threshold has been reached. In the present example, this determination may be based on a comparison of the notice threshold 70 stored in the usage threshold array 66 of memory 58 with the count value of counter 60. If NO, step S106 is repeated. If YES, the process proceeds to step S108.

At step S108, upon reaching the notice threshold, an image density of an image formed by printhead 36 on print medium 28 begins to be progressively reduced based on a print mode that imaging apparatus 12 was operating in when notice threshold 70 was reached. The progressive reduction of the image density is due to the incremental selection of a print density from the available print densities.

For example, a print fade level bit is set in the print fade level 1 location in print fade array 68 and a next (in this case the first) print density, e.g., of 90%, is selected, for example, by controller 56 via switching unit 62. Then, depending on the print mode that imaging apparatus 12 was in at the time of the occurrence of the event, the number of print swaths is counted, such as by control module 18. If, for example, the print mode in effect (previously selected by the user) was the Better Mode and the corresponding value for the number of print swaths, X=8, in Table 2 is used, then after control module 18 has counted eight print swaths, a next print fade level bit 2 is set in the print fade level 2 location in print fade array 68 and a next print density, e.g., of 80%, is selected, for example, by controller 56 via switching unit 62. This process proceeds until the last print fade level bit N is set in the print fade level N location in print fade array 68 and a next (in this case the last) print density, e.g., an image density of 3%, is selected, for example, by controller 56 via switching unit 62. Of course, the number of fade levels, i.e. the number of print densities available to effect the progressive reduction in printed image density, can be more or less than the example given above.

Figure 6:
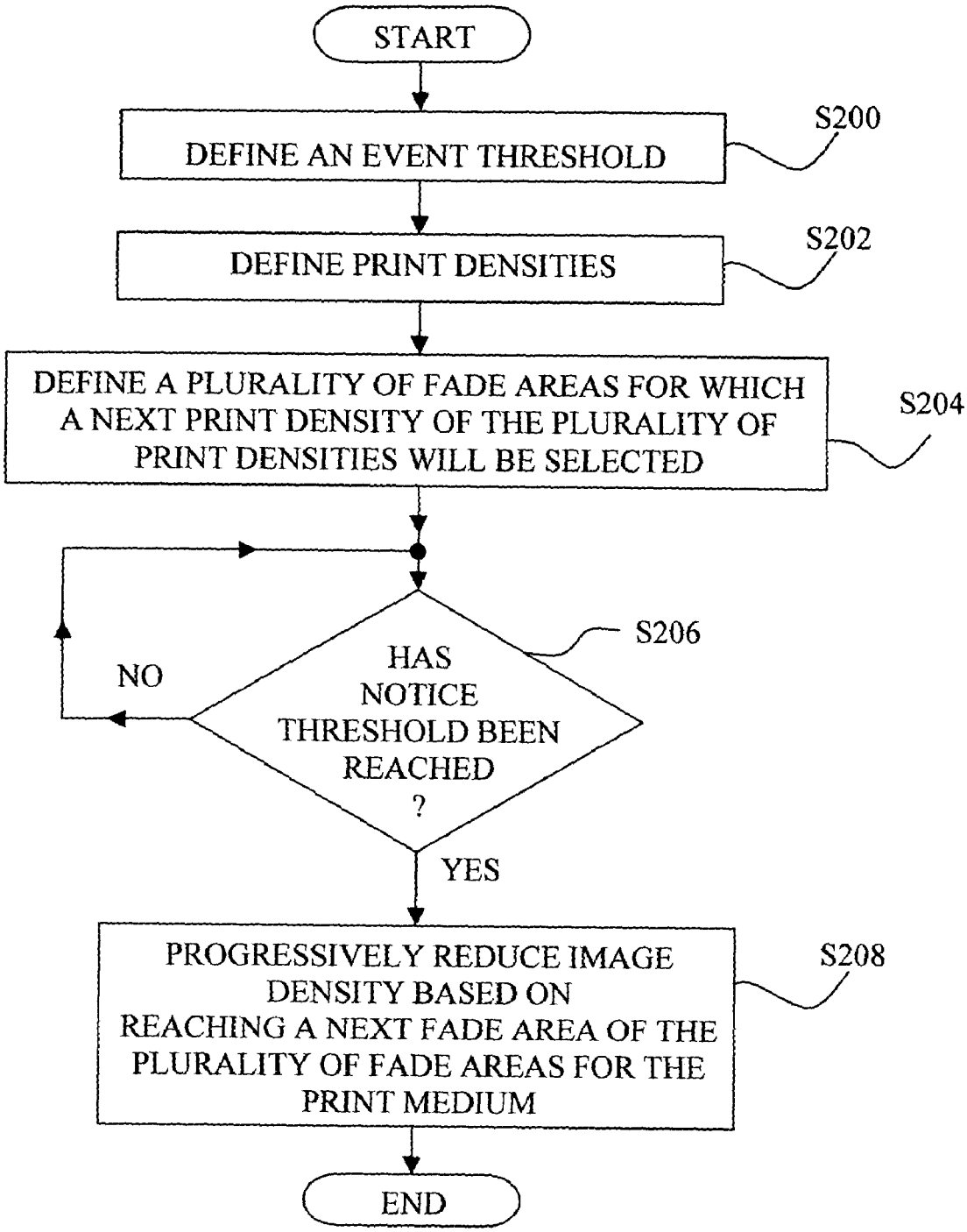
FIG. 6 is a general flowchart of another embodiment of a method for the present invention.

FIG. 6 is a flowchart of another method of informing a user of imaging apparatus 12 of an event.

At step S200, an event threshold is defined. In other words, the event to be monitored is identified and an indication of that event is defined as an event threshold. In keeping with the examples given above, the monitored event may be the event of a usable supply of ink in reservoir 37 becoming depleted, or about to be depleted, which is indicated when controller 56 reports to control module 18 that the estimated ink consumption has reached the value of notice threshold 70, i.e., the event threshold.

At step S202, a plurality of print densities are defined. Controller 56 associates a particular print density, i.e., fade amount, with each of the print fade level bits 1-N stored in print fade array 68. For example, if N=10, the ten levels of fade can be accommodated, corresponding to ten different print densities, e.g., 90%, 80%, 70%, 60% 50%, 40%, 30%, 20%, 10% and 3 percent. Each of the fade increments, e.g., from 90% to 80%, from 80% to 70%, etc., may be achieved, for example, via controller 56 and switching unit 62 selectively individually masking one or more of the plurality of primary address lines A1-An and/or secondary address lines C1-Cn. Alternatively, such fade increments may be achieved using other methods, such as by thinning the print data at either host 14 or control module 18, or by other methods known in the art.

Figure 7:
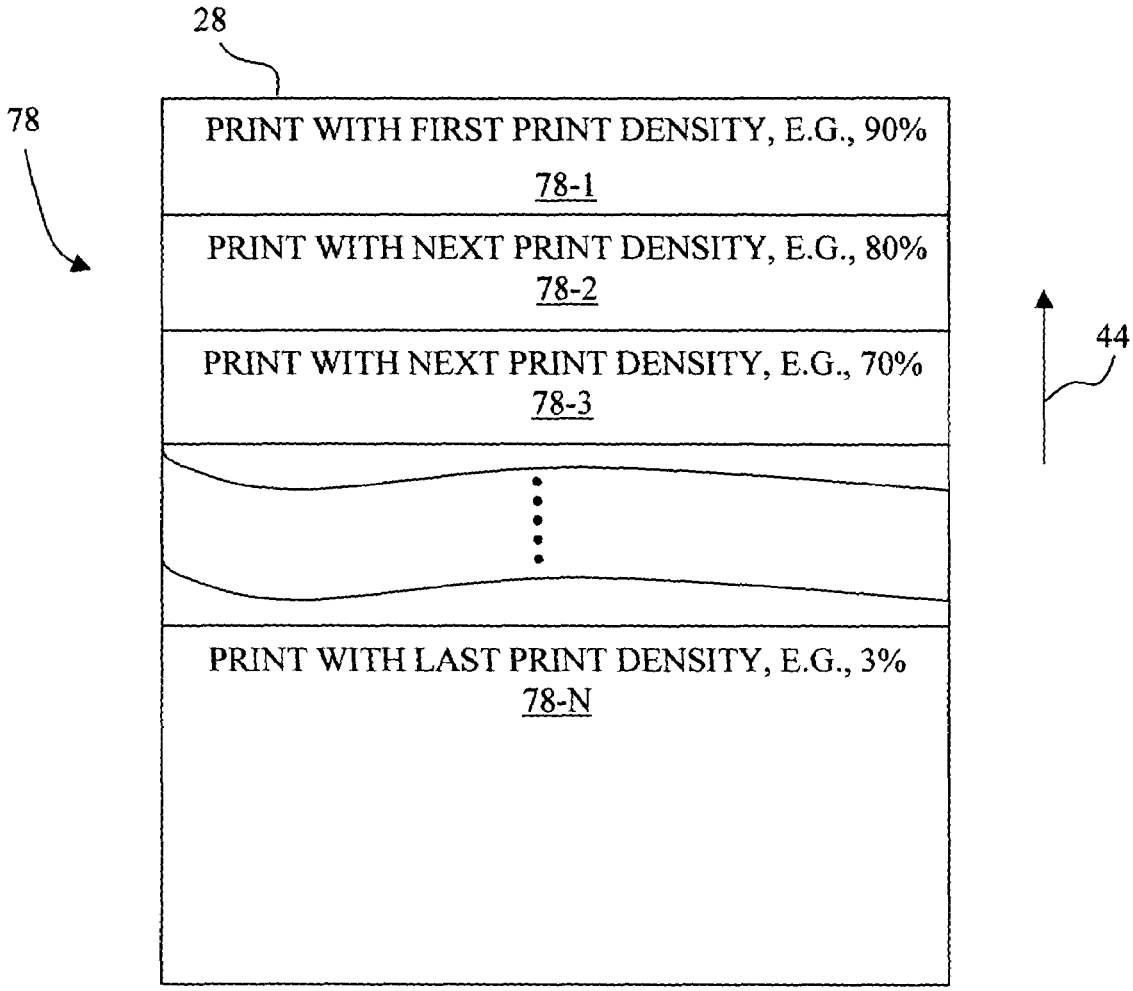
FIG. 7 is graphical depiction of a print medium including a plurality of fade areas that receive incremental fading in accordance with the method of FIG. 6.

At step S204, a plurality of fade areas associated with print medium 28 are defined for which a next print density of the plurality of print densities will be selected. For example, referring to FIG. 7, print medium 28 is shown having a plurality of predefined fade areas including, as shown, fade areas 78-1, 78-2, 78-3 through 78-N. In this embodiment, first fade area 78-1 through next-to-last fade area 78-N (minus 1) are of substantially the same size, with the last fade area 78-N representing the remainder of the fade areas at minimum print density. For example, wherein N=10, as in the examples given above, the first fade area 78-1 may be assigned a print density of 90%, second fade area 78-2 may be assigned a print density of 80%, third fade area 78-3 may be assigned a print density of 70%, and so on until reaching the last fade area 78-N which may be assigned the minimum print density of 3%. Thus, in this implementation, the fade level will incrementally decrease down the printed page on print medium 28. Furthermore, while fade area 78-1 is shown for convenience as being close to the top of print medium 28, the location fade area 78-1 may be dependent on the location of printhead 36 when the event occurs. The first fade area 78-1 may be located, for example, at a position corresponding to a next print swath to be printed after notice threshold 70 is reached. Thus, in practice, the location of first fade area 78-1 is not fixed, but rather, varies depending on the vertical position on print medium 28 of printhead 36 when the event occurred.

At step S206, it is determined whether notice threshold 70 has been reached. In the present example, this determination may be based on a comparison of the notice threshold 70 stored in the usage threshold array 66 of memory 58 with the count value of counter 60. If NO, step S206 is repeated. If YES, the process proceeds to step S208.

At step S208, upon reaching notice threshold 70, an image density of an image formed by printhead 36 on print medium 28 begins to be progressively reduced based on the predefined fade areas. More particularly, upon reaching notice threshold 70, an image density of an image formed by said imaging apparatus 12 is progressively reduce based on reaching a next fade area of a plurality of fade areas 78-1 through 78-N for a print medium, such as print medium 28. The term "next fade area" includes the transition from normal operation having no fade applied to the first print density associated with fade area 78-1, as well as all "next" fade areas after fade area 78-1. The progressive reduction of the image density is due to the incremental selection of a different print density from the available print densities as printing proceeds down the page.

For example, at the occurrence of the first fade area 78-1, a print fade level bit is set in the print fade level 1 location in print fade array 68 and a next (in this case the first) print density, e.g., of 90%, is selected, for example, by controller 56 via switching unit 62. Then, after reaching the next fade area 78-2, a next print fade level bit 2 is set in the print fade level 2 location in print fade array 68 and a next print density, e.g., of 80%, is selected, for example, by controller 56 via switching unit 62. This process proceeds until the last print fade level bit N is set in the print fade level N location in print fade array 68 and a next (in this case the last) print density, e.g., an image density of 3%, is selected, for example, by controller 56 via switching unit 62. Of course, the number of fade levels, i.e. the number of print densities available to effect the progressive reduction in printed image density, can be more or less than the example given above.

Thus, in accordance with the present invention, the user of imaging apparatus 12 is informed of the event by a progressive fading of the printed image in a manner that is readily discernable by the user as an indicator of the event.

While this invention has been described with respect to embodiments of the invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of informing a user of an imaging apparatus of an event, said imaging apparatus having a plurality of print modes, said method comprising the steps of:

defining a notice threshold that is associated with said event;

determining whether said notice threshold has been reached; and upon reaching said notice threshold, progressively reducing an image density of an image formed by said imaging apparatus based on a print mode said imaging apparatus was operating in when said notice threshold was reached.

2. The method of claim 1, further comprising the step of defining a respective number of print swaths for each of said plurality of print modes at which a next print density of a plurality of print densities will be selected to facilitate said progressively reducing step.

3. The method of claim 1, wherein said event is a depletion of a usable supply of imaging substance available to said imaging apparatus.

4. The method of claim 1, wherein said imaging apparatus is an ink jet printer, said notice threshold is one of a plurality of thresholds, each of said plurality of thresholds having associated therewith a respective corresponding amount of ink remaining.

5. The method of claim 1, further comprising the step of defining a plurality of print densities for use in progressively reducing said image density of said image.

6. The method of claim 5, wherein said imaging apparatus is an ink jet printer, said method further comprising the step of defining a respective number of print swaths for each of said plurality of print modes at which a next print density of said plurality of print densities will be selected.

7. The method of claim 6, wherein said respective number of print swaths increases with an increase of printing resolution of said plurality of print modes.

8. The method of claim 6, wherein a number of print swaths for a first print mode having a first print resolution is less than a number of print swaths for a second printing mode having a second print resolution higher than said first print resolution.

9. The method of claim 1, wherein said step of progressively reducing an image density is achieved relatively uniformly for each of a first print mode and a second print mode.

10. An imaging apparatus having a plurality of print modes selectable by a user, comprising:

a print engine;

a memory that stores a notice threshold associated with an event; and a control system coupled to said print engine and coupled to said memory, said control system being configured to perform the steps of:

determining whether said notice threshold has been reached; and upon reaching said notice threshold, progressively reducing an image density of an image formed by said imaging apparatus based on a print mode said imaging apparatus was operating in when said notice threshold was reached.

11. The imaging apparatus of claim 10, said control system being configured to perform the step of selecting a number of print swaths, from a plurality of numbers of print swaths associated with said plurality of print modes, at which a next print density of a plurality of print densities will be selected to facilitate said progressively reducing step.

12. The imaging apparatus of claim 10, wherein said event is a depletion of a usable supply of imaging substance available to said imaging apparatus.

13. The imaging apparatus of claim 10, wherein said imaging apparatus is an ink jet printer, said notice threshold is one of a plurality of thresholds, each of said plurality of thresholds having associated therewith a respective corresponding amount of ink remaining.

14. The imaging apparatus of claim 10, said control system being configured to perform the step of selecting a print density from a plurality of print densities for use in progressively reducing said image density of said image.

15. The imaging apparatus of claim 14, said control system being configured to perform the step of selecting a number of print swaths, from a plurality of numbers of print swaths associated with said plurality of print modes, at which a next print density of said plurality of print densities will be selected to facilitate said progressively reducing step.

16. The imaging apparatus of claim 15, wherein each number of print swaths of said plurality of print swaths increases with an increase of printing resolution of said plurality of print modes.

17. The imaging apparatus of claim 15, wherein a number of print swaths for a first print mode having a first print resolution is less than a number of print swaths for a second printing mode having a second print resolution higher than said first print resolution.

18. The imaging apparatus of claim 10, wherein said step of progressively reducing an image density is achieved relatively uniformly for each of a first print mode and a second print mode.

19. An ink jet printer having a plurality of print modes selectable by a user, comprising:

a carrier for carrying a printhead, said printhead being connected in fluid communication with a reservoir, said reservoir containing a supply of ink;

a memory that stores a notice threshold associated with a usable amount of ink in said reservoir having been depleted; and a control system coupled to said printhead and coupled to said memory, said control system being configured to perform the steps of:

determining whether said notice threshold has been reached; and upon reaching said notice threshold, progressively reducing an image density of an image formed by said ink jet printer based on a print mode said ink jet printer was operating in when said notice threshold was reached.

20. The ink jet printer of claim 19, said control system being configured to perform the step of selecting a number of print swaths, from a plurality of numbers of print swaths associated with said plurality of print modes, at which a next print density of a plurality of print densities will be selected to facilitate said progressively reducing step.

* * * * *